US006124801A

United States Patent [19]

Yamazaki

[11] Patent Number: 6,124,801

[45] **Date of Patent: *Sep. 26, 2000**

[54] RADIO SELECTIVE CALLING RECEIVER AND CALLING METHOD

[75] Inventor: Yasuyuki Yamazaki, Shizuoka, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/845,235

[22] Filed: Apr. 21, 1997

[30] Foreign Application Priority Data

Apr. 23, 1996 [JP] Japan ..... 8-101418

[51] Int. Cl.[7] ..... G08B 5/22

[52] U.S. Cl. ..... 340/825.44; 340/825.48; 340/575.1; 455/31.1; 455/38.1; 455/38.2; 370/313

[58] Field of Search ..... 340/825.44, 825.48; 455/31.1, 38.1, 38.2, 517, 426, 575, 140; 370/313

[56] References Cited

U.S. PATENT DOCUMENTS

| | | | |
|---|---|---|---|
| H1173 | 4/1993 | Davis et al. | 340/825.44 |
| 4,010,460 | 3/1977 | Derosa | 340/825.48 |
| 4,682,165 | 7/1987 | Davis | 340/825.44 |
| 4,701,759 | 10/1987 | Nadir et al. | 340/825.44 |
| 4,755,816 | 7/1988 | Deluca | 340/825.44 |
| 4,857,911 | 8/1989 | Mori et al. | 340/825.44 |
| 4,872,005 | 10/1989 | De Luca et al. | 340/825.44 |
| 5,012,219 | 4/1991 | Henry | 340/825.44 |
| 5,394,140 | 2/1995 | Wong et al. | 340/825.44 |
| 5,504,476 | 4/1996 | Marrs et al. | 340/825.44 |
| 5,623,242 | 4/1997 | Dawson, Jr. et al. | 340/825.44 |
| 5,663,717 | 9/1997 | De Luca | 340/825.44 |
| 5,815,081 | 9/1998 | Motohashi | 340/825.44 |
| 5,828,312 | 10/1998 | Yamazaki | 340/825.44 |
| 5,828,314 | 10/1998 | Park | 340/825.44 |

FOREIGN PATENT DOCUMENTS

| | | | |
|---|---|---|---|
| 0 499 247 A1 | 8/1992 | European Pat. Off. . | |
| 63-187433 | 11/1988 | Japan . | |
| 3-24828 | 2/1991 | Japan . | |
| 3-171937 | 7/1991 | Japan . | |
| 3-267826 | 11/1991 | Japan . | |
| 4-273727 | 9/1992 | Japan . | |
| 90/10359 | 9/1990 | WIPO | 340/825.44 |
| 92/03891 | 3/1992 | WIPO | 340/825.44 |

OTHER PUBLICATIONS

Motorola Watch Pager Brochure, 1990.

*Primary Examiner*—Brian Zimmerman
*Assistant Examiner*—Yves Dalencourt
*Attorney, Agent, or Firm*—McGuireWoods, LLP

[57] ABSTRACT

The message transmitter transmits a re-calling identification signal with a message, and a receiver identifies this signal. Thereby the message transmitter can indicate selectively the re-calling of the receiver. If the message is not confirmed, the receiver performs re-calling according to a previously set time interval with a second sound pattern different from the normal sound pattern for indicating that this message is an unconfirmed message until the message is confirmed. The receiver continues to perform the calling operation periodically until the receiver holder cancels the re-calling. Meanwhile the message is confirmed by switch operation with a third sound pattern of three short sounds which are not noisy.

10 Claims, 4 Drawing Sheets

1 ANTENNA
2
RADIO UNIT
3
WAVEFORM SHAPING CIRCUIT
4
5
PROM
6
RAM
7
TIMER
41
ID IDENTIFIER
42
MESSAGE IDENTIFIER
43
RE-CALLING IDENTIFIER
44
RE-CALLING CONTROLLER
12
LCD DRIVER
13
LCD DISPLAY
8
AMPLIFIER
9
10
AMPLIFIER
11
LED
14
CLOCK
15
POWER SWITCH
16 SET SWITCH
17 MEMORY SWITCH
18 MODE SWITCH

RADIO SELECTIVE CALLING RECEIVER AND CALLING METHOD

BACKGROUND OF THE INVENTION

1. Field of the Invention

This invention relates to a radio selective calling receiver and particularly relates to a re-calling announcing function of a radio selective calling receiver.

2. Description of the Related Art

In the conventional radio selective calling receiver, when a receiver receives a message, the received message is displayed on a liquid crystal display (LCD) and also a light emitting diode (LED) flickers to draw attention to the call. The calling announcement is reset after a certain time automatically if a user does not reset it. A message displayed on the LCD is stored in random access memory (RAM) as an unconfirmed message. The central processing unit (CPU) checks the existence of unconfirmed messages periodically, and when there is an unconfirmed message, the receiver displays the re-calling announcement which is different from the calling announcement.

A radio selective calling receiver of this sort is disclosed in Japanese Patent Laid-Open No. Hei 4-273727 (JP-A-04-273727).

In the re-calling announcing function of the conventional selective calling receiver, all the unconfirmed messages are involved regardless of the significance of the message. The receiver activates re-calling when the receiver receives a message which is not so significant for the receiver holder as the holder must confirm it immediately, and the re-calling consumes the power of a battery. Such a function is useful when a user does not hold the receiver and can not be aware of the re-calling. However,a common problem is that the receiver holder can stop the calling without confirming the message only by confirming the calling. Another problem occurs when the receiver confirms the message but opts to call-back later because the receiver can forget to do so.

In some cases, a message transmitter transmits a message to a receiver holder for requesting an urgent call-back, but the transmitter does not receive a call-back from the receiver holder, and thus can not know whether the receiver holder receives the message and confirms it. Yet another problem is that the transmitter then transmits the same message many times.

SUMMARY OF THE INVENTION

It is the object of the present invention to provide a radio selective calling receiver and a calling method having a function that a message transmitter can enable the receiver holder to recognize the urgency of the message and alleviate the concern that the receiver holder does not confirm the message. It is the other object of the present invention to provide a radio selective calling receiver and a calling method capable of operating the re-calling only for significant messages and preventing the meaningless consumption of power of a battery.

A radio selective calling receiver of the present invention includes an ID identification circuit for performing a calling announcing operation with a first sound pattern when the received radio signal identifies the address signal which coincides with the calling number of the receiver; a message identification circuit for analyzing the message signal subsequent to the calling number of the receiver and far outputting it as a message data, for performing auto-resetting to stop said announcing operation automatically when a reset operation input is not detected within a previously set time during the announcing operation, and for storing the message data in a memory as a unconfirmed message; a re-calling identification circuit for identifying whether the radio signal includes a signal for re-calling control; and a re-calling circuit for performing a recalling operation periodically with a second sound pattern which is different from the first sound pattern when this signal is confirmed and the received message is auto-reset.

The re-calling control circuit may perform re-calling operation of the confirmed message periodically with a third sound pattern different from both first and second sound patterns after the message is confirmed until the re-calling of the message is canceled.

A calling announcing method of the radio selective receiver of the present invention includes an announcing operation with the first sound pattern when an address signal which coincides with the calling number of the receiver is identified in the received radio signal; and an auto-resetting for stopping automatically the announcing operation, the received message stored in the memory as an unconfirmed message. The existence of this unconfirmed message is announced with the second sound pattern periodically with a time interval prescribed previously. Similarly, the re-calling announcing operation is performed periodically when the signal for re-calling control is identified in the radio signal, thus announcing the existence of a reset unconfirmed message with the second sound pattern different from the first sound pattern.

The re-calling announcing operation is performed periodically continuously after said message is confirmed until the re-calling of the message is canceled with a third sound pattern different from both the first and the second sound patterns.

BRIEF DESCRIPTION OF THE DRAWINGS

These and other objects, features and advantages of this invention will become more fully apparent from the following detailed description taken with the accompanying drawings in which.

DESCRIPTION OF THE PREFERRED EMBODIMENTS

Figure 1:
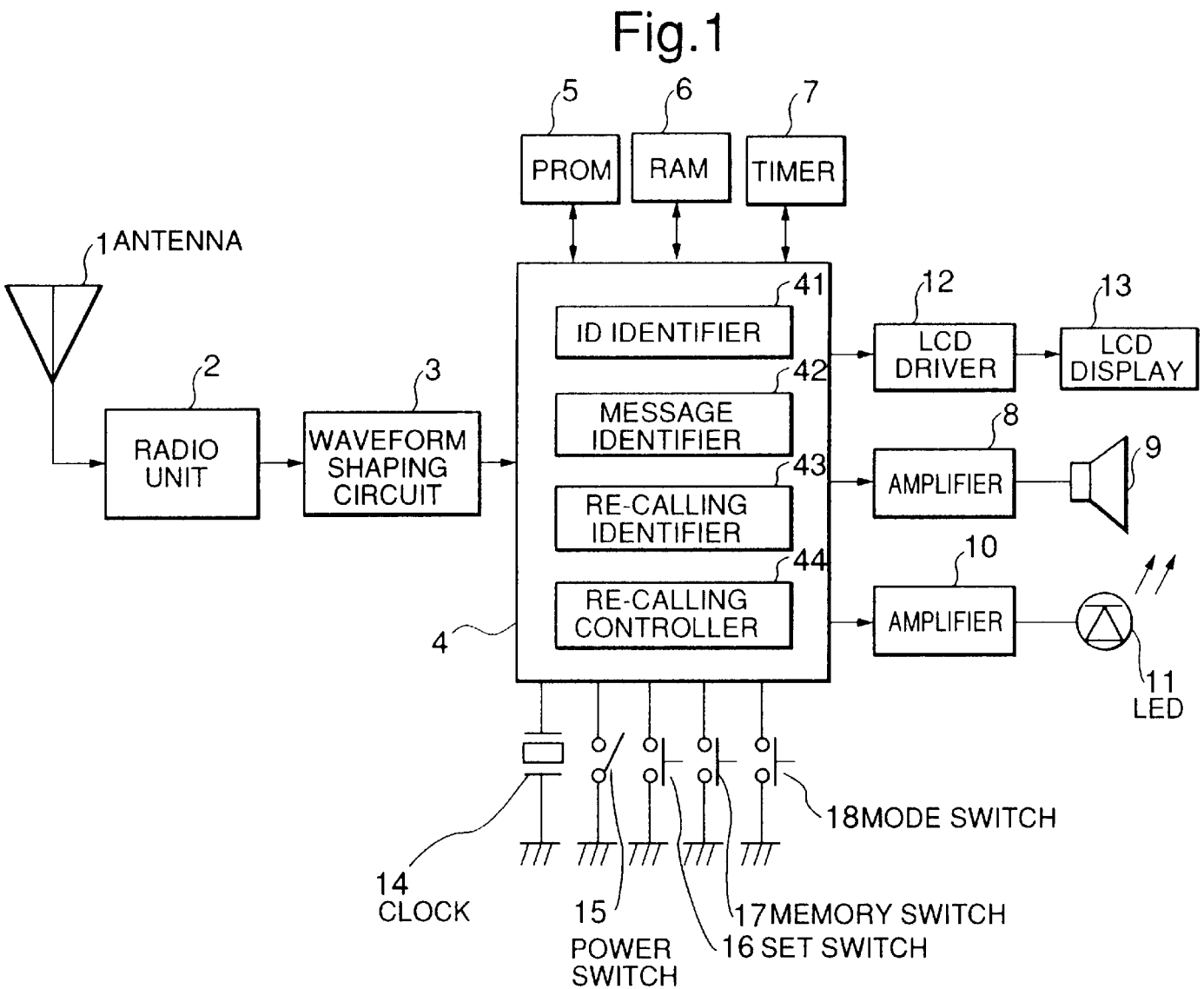
FIG. 1 is a block diagram of a preferred embodiment of the radio selective calling receiver of the present invention.

In FIG. 1 which shows a radio selective calling receiver, preferably a pager, an antenna 1 receives a transmitted radio signal. A radio circuit 2 amplifies and demodulates the radio signal received by the antenna 1. A waveform shaping circuit 3 converts the demodulated signal to a digital signal which the subsequent decoder 4 can read.

PROM 5 is a programmable read only memory, and stores the selective calling number of the receiver. RAM 6 stores received messages. A timer 7 sets previously the time interval of calling functions described herein.

The decoder 4 is provided with ID identifier 41, message identifier 42, re-calling identifier 43, and re-calling controller 44. The ID identifier 41 compares the data signal outputted from the waveform shaping circuit 3 with the calling number of the receiver written previously in the PROM 5. If both signal and number coincide, the ID identifier 41 outputs an alert signal of a normal first sound pattern to a amplifier 8 and an amplifier 10 to notify the radio selective calling receiver holder of the call.

The message identifier 42 analyzes a message signal following the calling number of the receiver, and outputs the message data to the LCD driver 12. If a reset operation input is not detected within a time previously set during the recognizing operation, the message identifier 42 sets the auto-reset for stopping automatically the recognizing operation, and stores the message data in RAM 6 as an unconfirmed message. The above-mentioned time previously set is stored in, for example, the timer 7. An unconfirmed message is stored, for example, with a flag for indicating that this message is an unconfirmed message.

The re-calling identifier 43 detects whether the received radio signal contains a signal for re-calling control. If the re-calling controller 44 detects the signal for re-calling control and the auto-reset of the received message is set, the re-calling controller 44 generates a second sound pattern different from the first sound pattern periodically for re-calling. Further, the re-calling controller 44 generates a third sound pattern different from both the first and the second sound patterns periodically for re-calling after the confirming of the received message until the re-calling for this message is canceled.

The amplifier 8 amplifies a speaker alert signal outputted from the decoder 4 and drives a speaker 9. The sounding of the alert sound announces a call to the radio selective calling receiver holder. The amplifier 10 amplifies an LED alert signal outputted from the decoder 4. The light generation of the LED 11 announces a call to the radio selective calling receiver holder. The speaker 9 and LED 11 announce a call with a usual sound mode.

A clock 14 is a clock generating oscillator for driving the decoder 4 and timer 7. A power switch 15 is a switch for supplying power to respective circuits. A set switch 16 is a push switch for stopping the alert sounds, for starting the display for confirming a message, and for resetting the re-calling function. A memory switch 17 is a push switch for invoking messages successively to the LCD display if a plurality of received messages are stored. A mode switch 18 is a push switch for changing to the setting mode for selecting the protection of the message, erasing, or cancel of re-calling function by pushing it while the received message is displayed on the LCD display 13.

Figure 2:
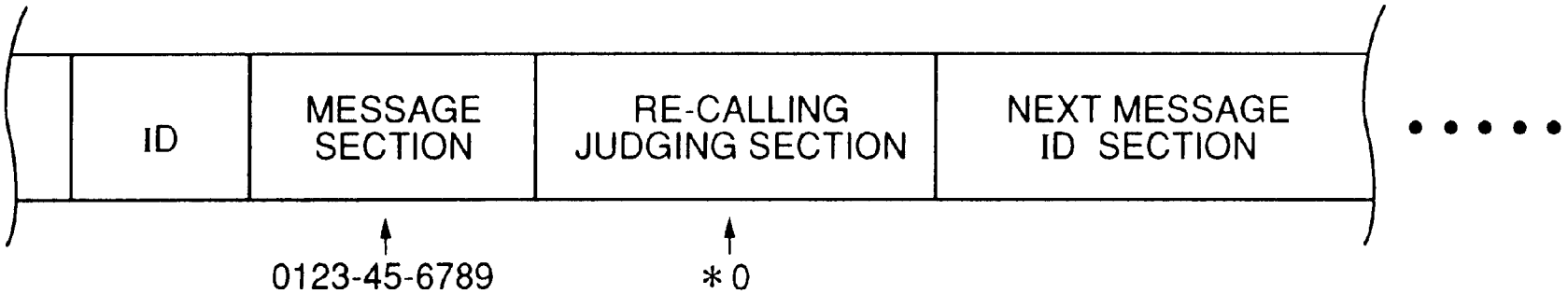
FIG. 2 is a diagram for illustrating the structure of transmitted message signal of the preferred embodiment of the present invention.

FIG. 2 shows a preferred example of a message signal transmitted from the transmitter if the message transmitter selects the re-calling. This signal is composed of the ID section for indicating the address of this receiver, the message section for indicating the message itself, and the re-calling judging section for indicating the existence of a request for re-calling followed by the next message ID section. The message transmitter adds, for example, "*(asterisk)0" subsequent to the message of, for example, 0123-45-6789 on a telephone, then a re-calling signal (re-calling identification number) is added in the transmitted radio signal, and the receiver identifies the message to be a message with re-calling when the receiver receives the signal.

Figure 3:
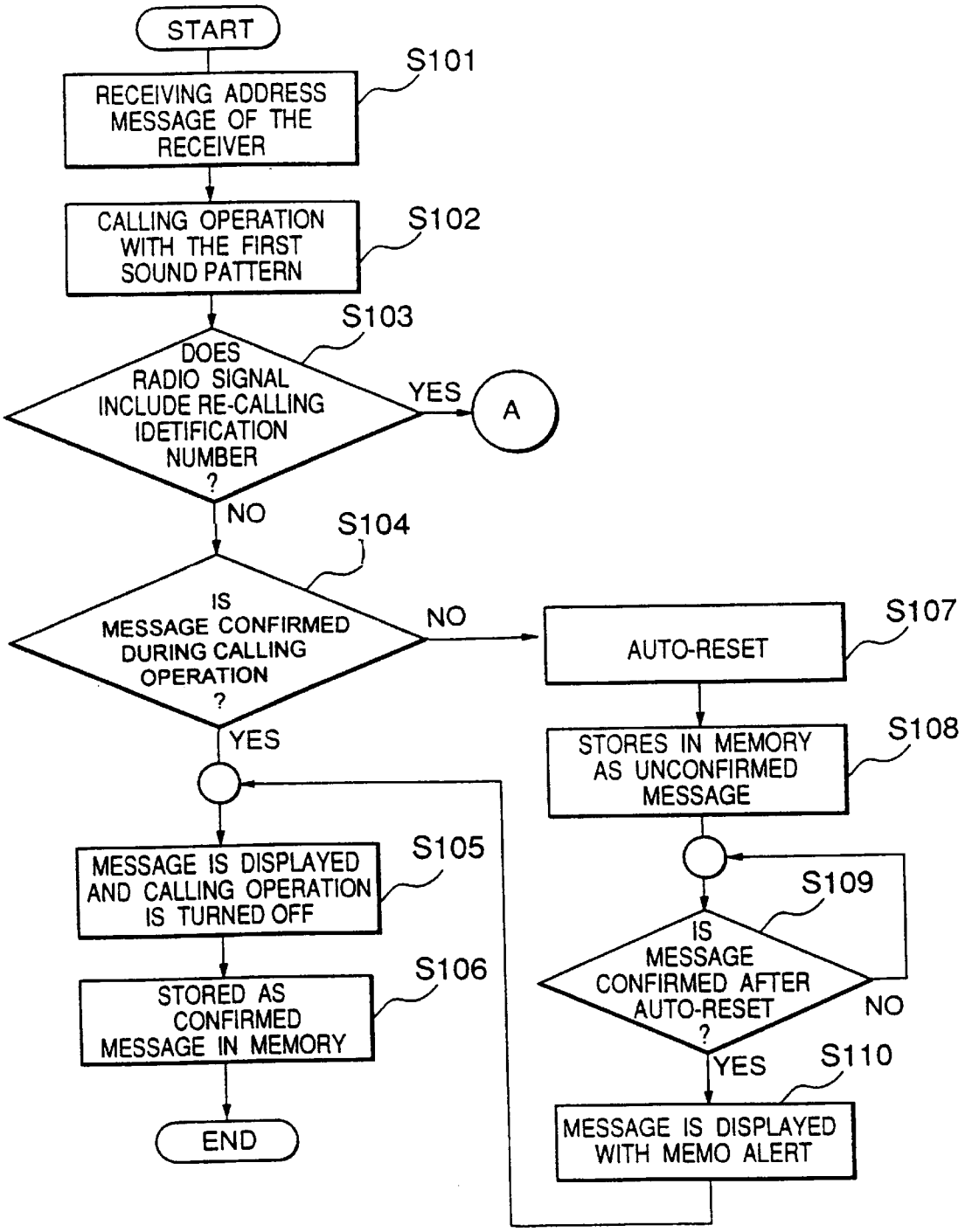
FIG. 3 is a flowchart for describing a first part of the sequence of the calling method in the preferred embodiment of the radio selective calling receiver of the present invention.
Figure 4:
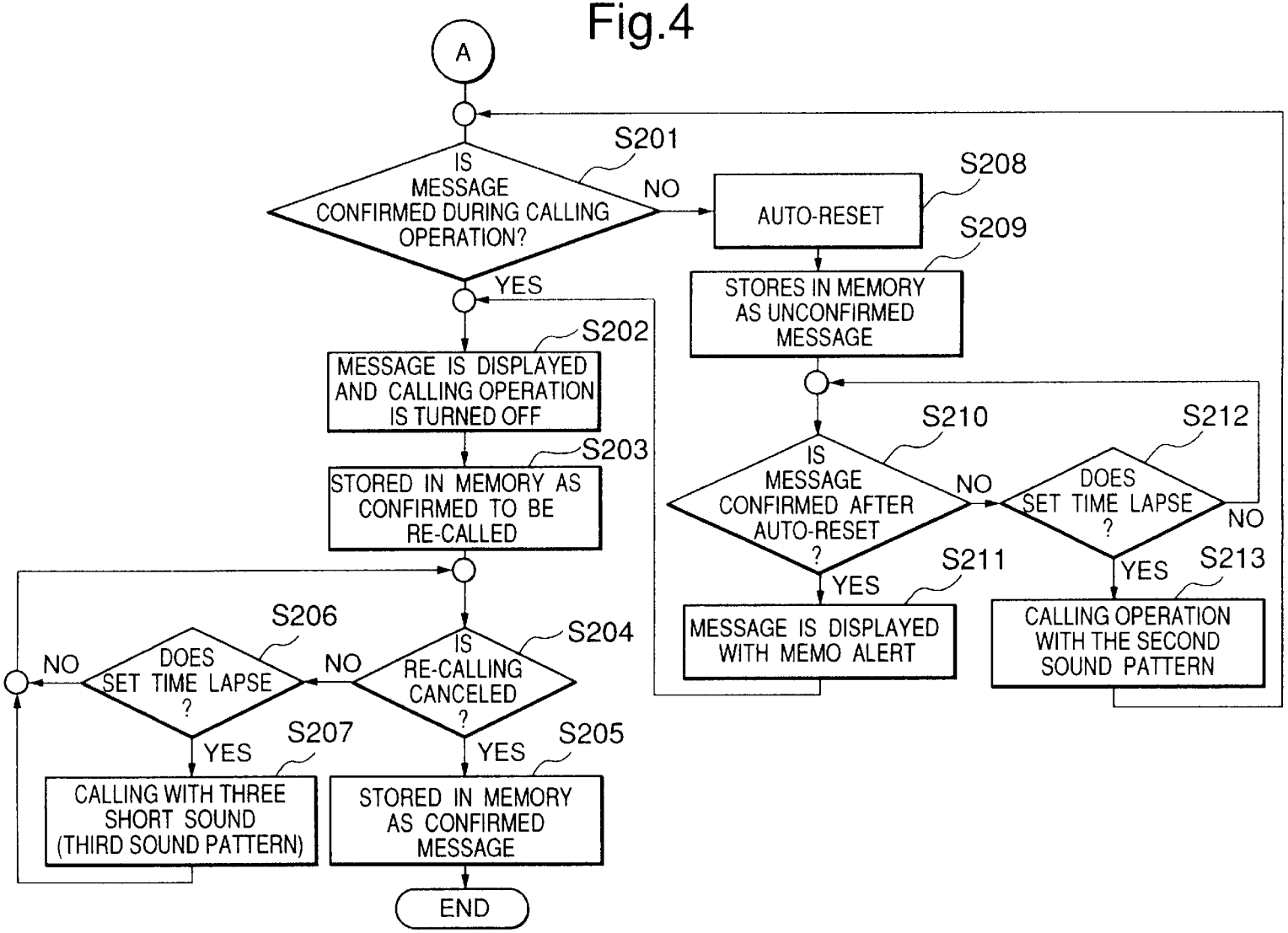
FIG. 4 is a flowchart for describing a second part of the sequence of the calling method in the preferred embodiment of the radio selective calling receiver of the present invention.

FIG. 3 and FIG. 4 show flow charts of the re-call announcing operations in the radio selective calling receiver of the present invention. The detail of the operation is described below referring to FIG. 1.

Upon switching the power switch 15 ON, the device enters a waiting condition awaiting the calling number (address) of the receiver. Upon receiving the calling number of the receiver under this condition (step S101), the receiver sounds with the normal first calling sound pattern, and displays the received message on the LCD display for indicating calling (S102).

The case that the re-calling identification number is not included in the received radio signal (S103, NO) is now described. By pressing down the set switch 16 during the calling operation (S102), the calling operation is turned OFF, thus ending the first sound pattern, and the message is confirmed (S104, YES). Then by pushing down the set switch 16 again, the message displayed on the LCD display 13 is turned off (S105), and stored in the memory (RAM) as a confirmed message (S106).

If the set switch 16 is not pushed down (S104, NO) during the calling operation (S102), auto-resetting is performed (S107), and the received message is stored in the memory as a unconfirmed message (S108). Afterwards, when the message is confirmed by pushing down the set switch 16 (S109, YES), the message is displayed on the LCD display 13, and simultaneously a second sound announcement (referred to as memo alert hereinafter) is performed to announce that the message is an unconfirmed message (S110). The memo alert is desirably different from the first sound pattern. Next, the case that the re-calling identification number is included in the received radio signal (S103, YES) is described by reference to FIG. 4. By pushing down the set switch 16 during the calling operation (S102), the message is confirmed (S201), then the calling operation, including the sound pattern, is turned OFF, and the message displayed on the LCD display 13 is turned off (S202) and stored in RAM 6 as a confirmed message to be re-called (S203). Afterwards, when the re-calling is canceled by switch operation (S204), the message is stored in RAM 6 (S205) and the sequence is brought to an end.

If the re-calling is not canceled (S204), a third calling operation (S207) is performed after a time previously set on the receiver (S206) by sounding three times a short sound (third sound pattern) (S207), which is not so loud as to feel noisy, for letting the receiver recognize that the message is a message including the re-calling identification number. Thereafter, the calling operation is repeated periodically until the re-calling is canceled.

On the other hand, if the message is confirmed by pushing down the set switch 16 (S201) during the calling operation (S102), the auto-resetting is performed (S208) and the received message is stored in RAM 6 (S209) as an unconfirmed message. Afterwards, when the message is confirmed by pushing down the set switch 16 (S201), the message is displayed on the LCD display 13 with memo alert (S211), and when the memo alert is turned OFF and the message is turned off by pushing down of the set switch 16 (S202), the message is stored in RAM 6 as a confirmed message for re-calling (S203). Thereafter, the third calling operation of three short sound is repeated (S207) periodically with a time interval set on the receiver (S206) until the re-calling is canceled (S204).

If the message is not confirmed (S210) by pushing down the set switch 16 after auto-resetting, after a time set on the receiver (S212), the memo alert (second sound pattern), which is different from both the normal (first) sound pattern (S102) and the three short sounds (third sound pattern), announces the existence of an unconfirmed message (S213) and the sequence returns to the step S201.

According to the present invention as described hereinbefore, a message transmitter transmits a re-calling identification signal with a message. Thereby, the re-calling operation of the receiver is commanded and controlled by the transmitter, and the message transmitter can let the receiver holder recognize the urgency of the message. Therefore, the message transmitter can get a relief from the concern of unconfirmed messages. Further, only the significant messages are re-called. Therefore needless consumption of battery power is prevented.

While the invention has been described with reference to specific embodiments thereof, it will be appreciated by those skilled in the art that numerous variations, modifications, and embodiments are possible, and accordingly, all such variations, modifications, and embodiments are to be regarded as being with in the spirit and scope of the invention.

What is claimed is:

1. A radio selective calling receiver comprising:

a radio unit which receives a radio signal including an ID and a message said radio signal further comprising a control signal when said message is identified as a message to be recalled;

a speaker which outputs a first sound pattern and a second sound pattern;

a memory which stores a received message;

a switch; and a decoder electrically connected to said radio unit, said speaker, said memory, and said switch, said decoder performing a first call notification by said first sound pattern from said speaker when said ID coincides with a calling number of said receiver, said decoder stopping said first call notification as an auto-reset condition when a predetermined time elapses without operation of said switch, said decoder storing said received message into said memory as an unconfirmed message under said auto-reset condition, said decoder repeating a notification by said second sound pattern periodically after a stopping of said first call notification when said unconfirmed message is stored in said memory and said control signal is contained in said received signal.

2. The radio selective calling receiver as claimed in claim 1, wherein said speaker outputs a third sound pattern which is repeated after said switch is operated to change said unconfirmed message to a confirmed message.

3. The radio selective calling receiver as claimed in claim 2, wherein said third sound pattern is canceled when said switch is operated to cancel said another notification.

4. A radio selective calling receiver comprising:

receiving means which receives a radio signal;

notifying means which performs a call notification;

storing means which stores a received message included in said radio signal;

operating means for operation by a user; and controlling means, electrically connected to said receiving means, said notifying means, said storing means and said operating means, said controlling means comprising:

means controlling said notifying means for performing a call notification by a first sound pattern when an ID included in said radio signal coincides with a calling number of said receiver;

means for stopping said call notification as an auto-reset condition without operation of said operating means;

means for storing an information indicating whether or not a control signal is included in said radio signal with said received message stored as an unconfirmed message in said storing means under said auto-reset condition; and means controlling said notifying means for repeating a re-call notification by a second sound pattern after a stopping of said call notification when said unconfirmed message exists in said storing means and said information indicates that said control signal is included in said radio signal.

5. The radio selective calling receiver as claimed in claim 4, wherein said re-call notification by said second sound pattern is changed to another re-call notification by a third sound pattern when said unconfirmed message is changed to a confirmed message by operation of said operating means.

6. The radio selective calling receiver as claimed in claim 4, wherein said re-call notification is cancelled by an operation of said operating means.

7. A call notifying method of a radio selective calling receiver comprising the steps of:

receiving a radio signal;

judging whether or not an ID included in said radio signal coincides with a calling number of said receiver;

notifying a user of an incoming call by a first sound pattern when said ID coincides with said calling number and a message is included in said radio signal;

resetting a first call notification by a first sound pattern without a switch operation;

judging whether or not a control signal is included in said received signal;

storing said message included in said received signal as an unconfirmed message after resetting said first notification; and repeating a second call notification by a second sound pattern periodically after a predetermined time elapses from resetting said first notification when said unconfirmed message is stored and said control signal is contained in said received signal.

8. The call notifying method of a radio selective calling receiver as claimed in claim 7, further comprising the steps of:

storing said message as a confirmed message when said control signal exists and a switch operation is executed during said first call notification; and periodically repeating a third call notification by a third sound pattern according to a predetermined cycle when said control signal exists and said confirmed message is stored.

9. A call notifying method of a radio selective calling receiver comprising the steps of:

receiving a radio signal;

judging whether or not an ID included in a received signal coincides with a calling number of the receiver;

notifying a user of an incoming call by a first sound pattern when said ID coincides with said calling number and a message is included in said received signal;

resetting a call notification by said first sound pattern without a switch operation;

judging whether or not a control signal requesting a re-call notification is included in said received signal;

storing said message included in said received signal as an unconfirmed message after resetting said first notification; and repeating said re-call notification by a second sound pattern periodically after a predetermined time elapses from resetting said call notification when said unconfirmed message contains said control signal requesting re-call notification.

10. The call notifying method of a radio selective calling receiver as claimed in claim 9, further comprising the steps of:

storing said message as a confirmed message when said control signal requesting a re-call notification exists and a switch operation is made during said first call notification; and periodically repeating a third call notification by a third sound pattern according to a predetermined cycle when a confirmed message requesting re-call notification exists.

* * * * *